United States Patent [19]

Tielker et al.

[11] Patent Number: 5,050,756

[45] Date of Patent: Sep. 24, 1991

[54] METHOD AND APPARATUS FOR STORING, TRANSPORTING AND TRANSFERRING PRODUCTION GOODS

[75] Inventors: Uwe G. Tielker, Costrop-Rauxel; Heinz-Georg Pater, Ense, both of Fed. Rep. of Germany

[73] Assignee: Lista AG, Erlin, Switzerland

[21] Appl. No.: 587,027

[22] Filed: Sep. 24, 1990

Related U.S. Application Data

[63] Continuation of Ser. No. 174,202, Mar. 28, 1988, abandoned, which is a continuation of Ser. No. 811,401, Dec. 20, 1985, abandoned.

[51] Int. Cl.[5] ..... B65D 25/20

[52] U.S. Cl. ..... 220/23.4; 206/501

[58] Field of Search ..... 220/20, 23.4, 23.83, 220/23.86; 206/499, 501, 514; 217/26, 27, 26.5

[56] References Cited

U.S. PATENT DOCUMENTS

| | | | |
|---|---|---|---|
| 1,664,245 | 4/1925 | Coyle | 220/505 |
| 2,389,337 | 11/1945 | Zademach et al. | 134/94 |
| 2,695,112 | 11/1954 | Bonnevay | 220/22.3 |
| 2,851,188 | 9/1958 | Pavelle | 206/501 |
| 3,286,834 | 11/1966 | English | 217/27 |
| 3,349,941 | 10/1967 | Wanderer | 220/411 |
| 3,498,494 | 3/1970 | Voorhees | 206/501 |
| 3,754,645 | 8/1973 | Kilroy | 217/26 |
| 4,242,834 | 1/1981 | Olsen | 206/514 |

FOREIGN PATENT DOCUMENTS

| | | | |
|---|---|---|---|
| 0104136 | 3/1984 | European Pat. Off. . | |
| 0123077 | 7/1984 | European Pat. Off. . | |
| 2728735 | 1/1979 | Fed. Rep. of Germany | 206/501 |
| 3441653 | 4/1986 | Fed. Rep. of Germany . | |
| 2279635 | 2/1976 | France | 206/501 |
| 555729 | 11/1974 | Switzerland . | |
| 665154 | 4/1988 | Switzerland . | |
| 1595041 | 3/1977 | United Kingdom . | |
| 1560488 | 2/1980 | United Kingdom | 220/23.83 |

OTHER PUBLICATIONS

The Journal Schweizer Maschinenmarkt 46/1984, p. 11.

Brochure Stanley-Vidmar, "Tool Handling & Delivery System", dated 1983.

Brochure Susta, "Multicontrol System", dated 1978.

Brochure, "Lista Macht Ordnung Zum System", dated 1981.

Brochure, Emag-Norm, "Ein Neues Lager-Un Transport System fur Werkzeuge NC-Gesteuerter Maschinen", p. 7, having no recognizable date.

*Primary Examiner*—Steven M. Pollard

*Attorney, Agent, or Firm*—Bachman & LaPointe

[57] ABSTRACT

Parts receptacles adapted to the shape of the parts are used for receiving the latter. A plurality of parts receptacles are positioned in an intermediate frame, while several intermediate frames are positioned in a base frame. The connection of the parts, parts receptacles, intermediate frames and base frames to one another takes place in positve and/or non-positive manner. Through this subdivision of the apparatus into the indicated components, flexible adaptation to material flow functions in plants and equipment is possible, independently of whether handling of the parts takes place manually, semi-automatically or fully automatically. An additional frame for the base frame is used for stacker transportation purposes.

8 Claims, 4 Drawing Sheets

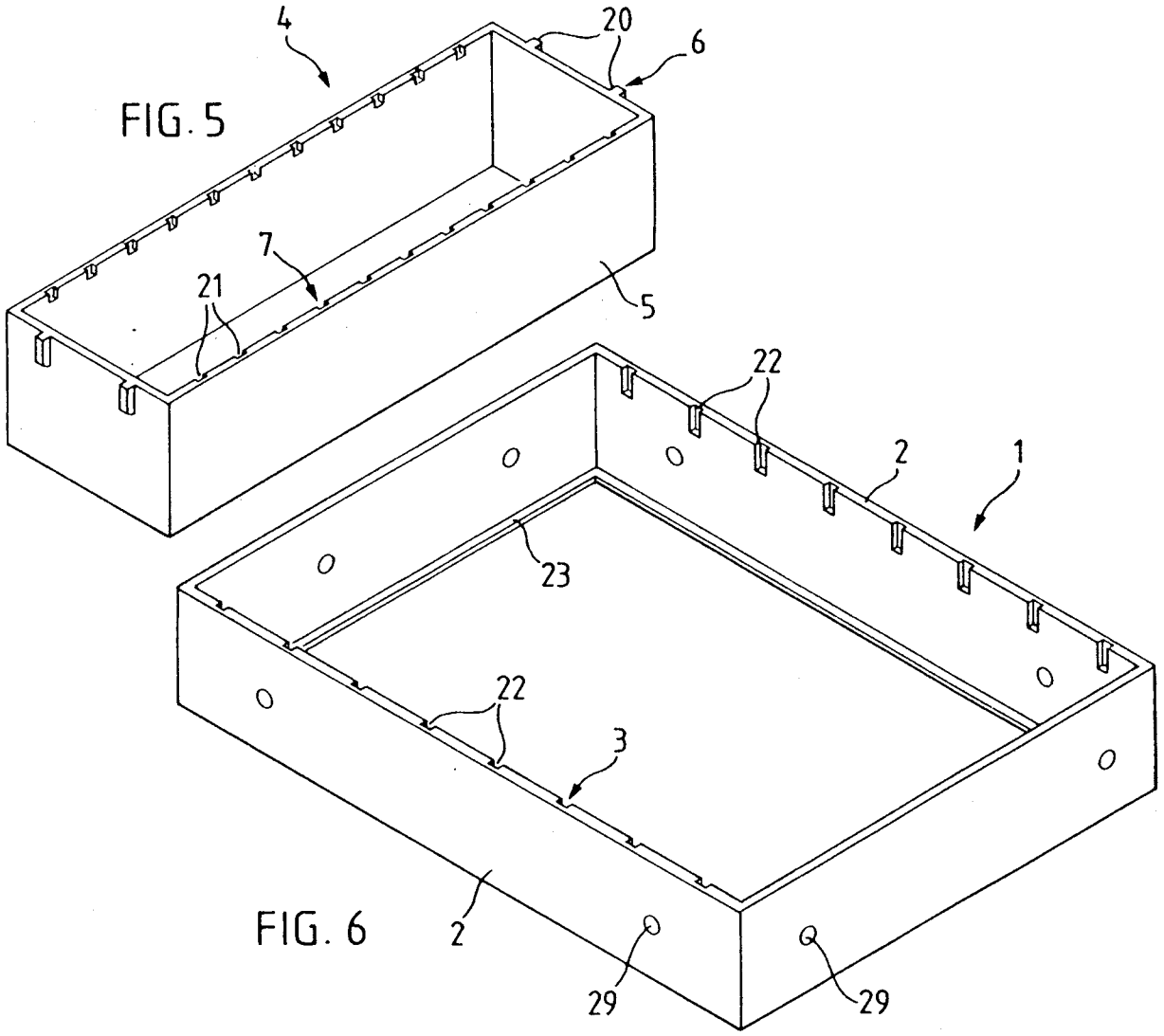
FIG. 5
FIG. 6
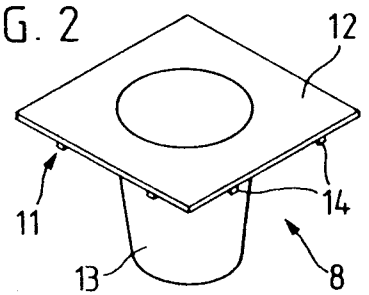
FIG. 2
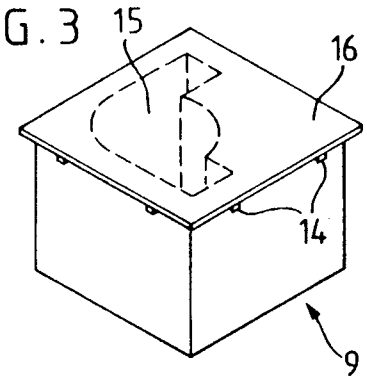
FIG. 3
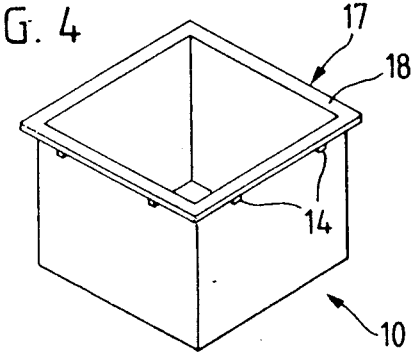
FIG. 4

FIG. 9
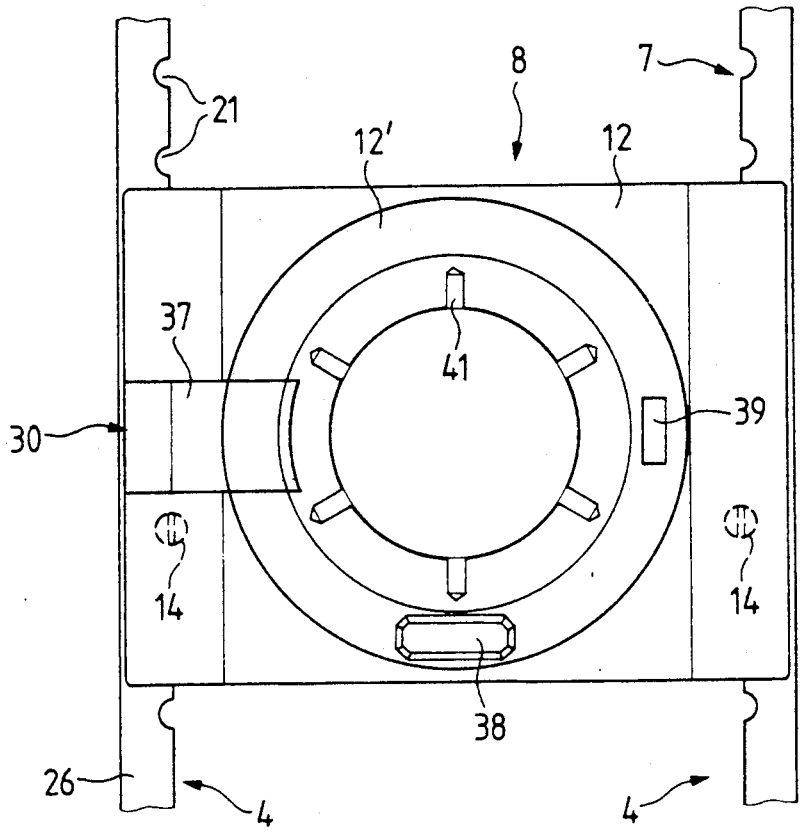
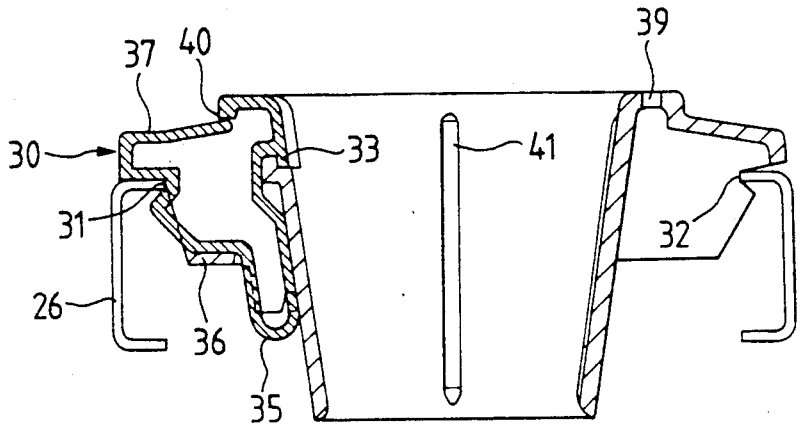
FIG. 10

METHOD AND APPARATUS FOR STORING, TRANSPORTING AND TRANSFERRING PRODUCTION GOODS

CROSS-REFERENCE TO RELATED APPLICATIONS

This is a continuation of U.S. patent application Ser. No. 174,202, filed Mar. 28, 1988 which is a continuation of U.S. patent application Ser. No. 811,401, filed Dec. 20, 1985, both now abandoned.

BACKGROUND OF THE INVENTION

The present invention relates to a method for storing, transporting and transferring production goods, such as tools, workpieces and other parts, in which the part or parts is or are stored in a parts holder or container, two or more such holders or containers being received in a support member, as well as to an apparatus for performing the method. The term "production goods" can be understood as material parts in the widest sense in connection with which the aforementioned method and apparatus can be used.

Various methods and apparatuses for storing, transporting and transferring production goods are known. In general, such methods and apparatuses are adapted to specific plants and production systems and are consequently not universally usable.

Numerous attempts have been made to develop such methods and apparatuses, which can be integrated into different plants.

An apparatus for storing, transporting and transferring production goods is known (U.S. Pat. No. 3,819,058), in which frame-like support members are used, on which the parts are held in positively engaged manner by means of parts holders. The spacings and arrangement of the parts can be varied. Although several parts holders can be combined into transportation units, which can be manipulated by means of various conveying technologies, such as, for example, fork-lift trucks, roller conveyors, etc., and are readily accessible for manual transfer, this still cannot insure automatic operation, for example, in conjunction with robots and insertion and removal means.

SUMMARY OF THE INVENTION

The problem of the present invention is to so further develop a method of the aforementioned type that it can be used on all plants and production locations, no matter how the plant or production location is designed or whether a fully automated or manual operation or material flow is used. According to the invention this problem is solved in that the parts holders in the supporting member and also two or more supporting members can be positioned in a basic supporting member in a specific position. Thus, independently of the type and shape of the parts, their predetermined positioning can always be insured.

The invention also covers an apparatus enabling the method according to the invention to be performed in an optimum manner. This problem is solved by an apparatus in which a loading aid formed from components is provided, the components being constituted by a base frame constructed as a basic support member, an intermediate frame constructed as a support member and a parts receptacle constructed as a parts holder, whereby said components can be combined as required in a specific position by means of a reference grid system. As all the components have this grid system, they can be combined in a flexible manner, either wholly, partly or as individual components, so as to permit optimum adaptation to the particular plant or means.

BRIEF DESCRIPTION OF THE DRAWINGS

The invention is described in greater detail hereinafter relative to non-limitative embodiments and the attached drawings, which show:

FIG. 2 is a parts receptacle C for tools with a grid system in direction Y;

FIG. 3 is a parts receptacle C for workpieces with a grid system in direction Y;

FIG. 4 is a parts receptacle C for small parts with a grid system in direction Y;

FIG. 5 is an intermediate frame B for receiving parts receptacles according to FIGS. 2 to 4, with an external grid system in direction X and an internal grid system in direction Y;

FIG. 6 is a base frame A with an internal grid system in direction X;

FIG. 9 is a plan view of a parts receptacle similar to FIG. 2; and

FIG. 10 is a vertical section through the parts receptacle of FIG. 9.

DETAILED DESCRIPTION OF THE PREFERRED EMBODIMENTS

The invention is based on the consideration that the adaptation of a storing, transporting and transferring system with its means to random plants, production locations and the like can in particular be insured in optimum manner if an apparatus formed from several components is available and whose use can be inexpensively and flexibly adapted to the requirements of automatic or partly automatic operations, but which can itself be used in a similar advantageous manner for manual operation.

Figure 1:
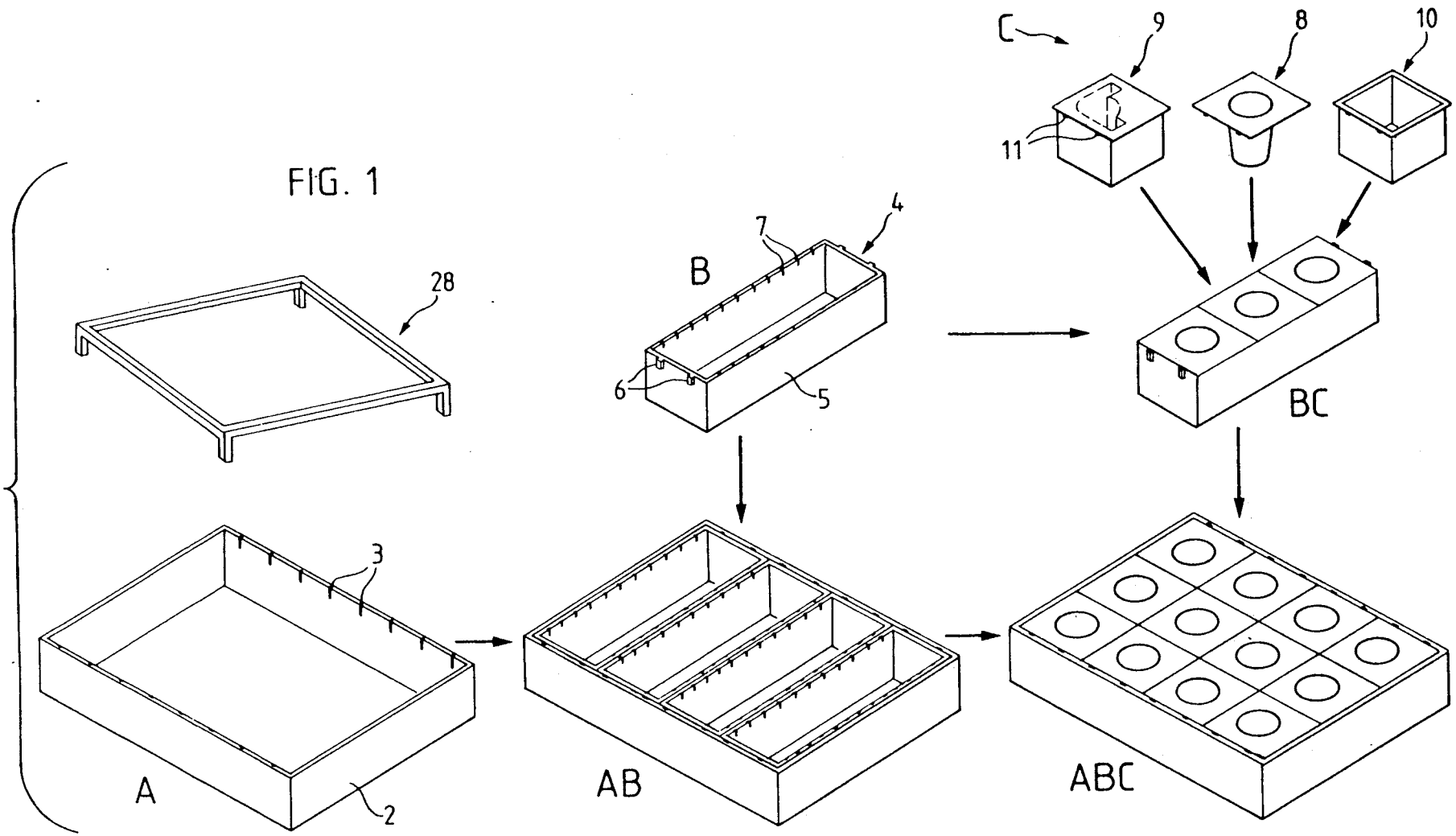
FIG. 1 is a diagrammatically represented loading aid for storing, transporting and transferring material parts, whose components are shown in a three-dimensional and pulled-apart view.

FIG. 1 shows a loading aid with its components satisfying the aforementioned requirements. The loading aid can comprise three components A, B, C, with component A being constructed as the basic supporting member in the form of a base frame 1. Base frame 1 is essentially rectangular and formed from walls 2. On at least two walls is provided a diagrammatically shown reference grid system 3, whose function and construction will be described in greater detail hereinafter. The grid system is provided on two facing walls 2 and is called the grid system in direction X.

Component B is constructed as an intermediate frame 4, which forms a support member for component C. Intermediate frame 4 is also rectangular and is formed from walls 5. On two facing walls, intermediate frame 4 is provided with an external grid system 6 in direction X, while the two other facing walls 5 have an internal grid system 7 in direction Y.

Component C constitutes a parts receptacle, whereof three different embodiments S, 9, 10 are shown. 8 is a parts receptacle, which is more particularly suitable for receiving tools with cylindrical and conical shaft or shank portions. 9 is a parts receptacle for receiving workpieces with a random shape and which is appropriately adapted to the particular workpiece to be received. If slightly randomly shaped workpieces and in particular small parts are to be received in a parts receptacle, it is possible to use receptacle 10, cf. FIG. 4, which is essentially trough-shaped.

Components C are also provided with a grid system, in this case there is an external grid system 11. If the parts receptacles 8, 9, 10 are square, they can be placed in intermediate frame 4 in four different positions, so that the external grid system 11 can then be arranged both in direction X and in direction Y. However, if the parts receptacle 8, 9, 10 has a rectangular shape, then the external grid system 11 must be arranged in direction Y.

It can also be seen from FIG. 1, that the components can be joined together to form partial units or units. In this way, through connecting components A and B, partial unit AB and by connecting components B,C, partial unit BC are formed. Unit ABC is formed through connecting components A, B and C.

It is clear that the dimensions of component B have part of component A and the dimensions of component C part of component B.

In FIGS. 2 to 4 are shown square parts receptacles 8, 9, 10. Parts receptacle 8 essentially has a plate 12, to which is centrally joined a cylindrical or conical sleeve 13. Sleeve 13 ca also be constructed with a base or a support band to permit axial supporting of the tool to be received. On the edges of plate 12 are provided the external grid system both in direction X and in direction Y and which is constituted by pins or the like 14. Through the arrangement of pins 14 in both directions, plates 12 and consequently the tool placed therein can be arranged in positions displaced by 90°.

Parts receptacle 9 essentially has a cavity 15, whose walls are adapted to the particular workpiece. The grid system is arranged in the same way in the form of pins or the like 14 on the edges of a reception or mounting plate 16. As shown in FIG. 4, parts receptacle 10 is arranged in a container 17 with an edge flange 18, on which are provided pins or the like 14.

The intermediate frame 4 shown in FIG. 5 has an external grid system 6 in direction X in the form of pins 20, while the internal grid system 7 in direction Y has spaced recesses 21. The pins 14 of parts receptacles 8, 9, 10 can be placed in recesses 21 and correspondingly positioned in a specific position as a result thereof, so that the part stored in the parts receptacle is also positioned.

In the case of the base frame 1 shown in FIG. 6, in two facing walls 2, the internal grid system 3 in the direction X is formed by a plurality of equidistantly spaced recesses 22. Intermediate frame pins 20 running in direction X can be engaged in recesses 22. Thus, the intermediate frame 4 is positioned, as are the parts receptacles 8, 9, 10 with their parts located therein. Base frame 1 is provided on the insides of walls 2 with a collar 23, on which can be supported the inserted intermediate frames 4. Collar 23 can also be differently constructed, for example, as a base.

Figure 7:
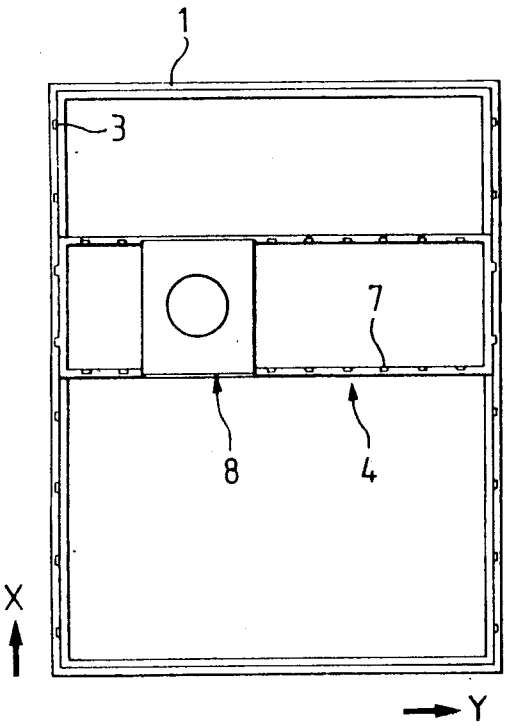
FIG. 7 is a diagrammatically represented plan view of the loading aid according to FIG. 1 with joined components.

FIG. 7 shows the connecting of a parts receptacle 8 for tools in an intermediate frame 4, which is in turn inserted in base frame 1. It is clear therefrom that the parts receptacle 8 can be arranged with the aid of grid systems 3, 6, 7, 11 in a random, but positioned location within the base frame 1.

Figure 8:
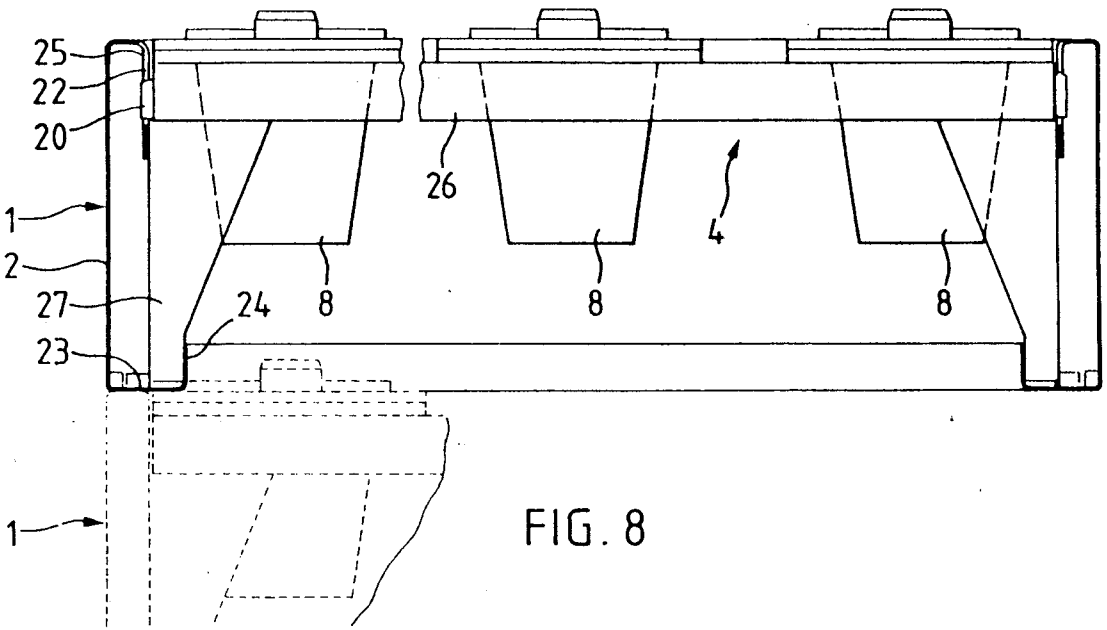
FIG. 8 is a side view of a further loading aid in a stackable arrangement.

FIG. 8 also shows that the base frames 1 are stackable, no matter what the construction of said frame 1. Stacking is still possible if one or more intermediate frames 4, together with parts receptacles 8, 9, 10 are placed in base frame 1. The base frame 1 according to FIG. 8 is made from sheet metal, collar 23 with a shaped on rim 24 being provided at the bottom on walls 2. The upper edge of wall 2 is also beaded and forms a portion 25 parallel thereto, in which the recesses are worked in the form of slots 22.

The intermediate frame 4 according to FIG. 8 has two longitudinal girders 26, which are bounded at their ends by frontal walls (not shown) with bent webs 27. The base-side end of webs 27 can be inserted between rim 24 and wall 22 and also intermediate frame 4 can be positioned with pins 20. Webs 27 and consequently the intermediate frame are horizontally positioned by rims 24 and vertically positioned by the depth of slots 22.

The parts receptacles 8 inserted in intermediate frames 4, whereby the parts receptacles 9, 10 can be inserted in the same way, are placed by means of their pins 14 in recesses 21, which can also be constructed in the form of slots in the longitudinal girders 26.

Pins 14, 20 and recesses 21, 22 of components A, B, C form a positive connection, which does not permit a reciprocal displacement of the components. There can also be a non-positive engagement of components A, B, C, for example, with a catch spring, which releases a given force on application. The non-positive engagement can also be provided by a clamp releasable manually or by means of a tool.

FIGS. 9 and 10 show in detail a parts receptacle 8 similar to that of FIG. 2. Plate 12 forms with the conical sleeve a single piece, for example, of plastic. Plate 12 has a raised circular edge 12', in which is provided an opening 39. A further opening 39 is filled by a positioning pin 38, which is used for positioning the tool in the conical sleeve 13. Thus, the tool can be positioned in two positions varying by 90° with the aid of pin 38.

As shown in FIG. 10, the parts receptacle is provided below plate 12 with an engaging cavity 31, 32 on two opposite sides, with the aid of which the parts receptacle 8 can be supported in non-positively engaging manner in the longitudinal girders 26 of intermediate frame 4. In order that the parts receptacle 8 can be removed from intermediate frame 4, one engaging depression 31 is provided in a snap element 30, which can be inserted as a separate part in a recess of plate 12. As shown in FIG. 10, the snap element 30 is a hollow section which, as known, has the engaging recess 31 and for this a hook-like retaining edge 33 and an engaging part 35. The retaining edge 33 and the engaging part 35 positively held between sleeve 13 and a bearing web 36 on the one hand insure a reliable connection of snap element 30 to parts receptacle 8 and on the other hand make it possible to replace snap element 30. A particular advantage of snap element 30 is constituted by a tongue 37, which can be depressed for removing the parts receptacle 8 from intermediate frame 4, but as a result of its shape provides a complete cover for the hollow section, in that its free end projects below an edge 40. As a result of this shape of tongue 37, it is insured that foreign bodies, for example, chips, shavings, etc. cannot drop into the hollow section and lock the snap element.

On the inner wall of sleeve 13 are provided recesses 41, in which are placed webs, which project somewhat and support a tool inserted in the sleeve. The resulting narrow bearing faces for the tool insure an easy separation thereof from the parts receptacle 8. If the webs are given a resilient construction, on inserting the tool in sleeve 13, there is a reaction force, which additionally aids the separation of the tool from sleeve 13. The reference numerals not described in FIGS. 9 and 10 coincide with those of FIGS. 1 and 2.

The described method and apparatus for storing, transporting and transferring parts constitutes a flexible working means for permitting in an optimum manner the material flow between different stations, both in connection with small parts and workpieces. It is not bound by any special conveying technology but, through the positioning of its components by means of a reference grid system, offers the possibility of achieving automatic loading and unloading by handling equipment. Workpieces and tools are directly grasped by handling equipment, whereas small parts are appropriately emptied into containers or supply devices close to the station, for example, vibrating conveyors. The intermediate frame 4 can also form an independent unit for carrying out the material flow functions. As many material flow functions are solved by standardized pallets, it is appropriate to construct the base frame 1 with similar dimensions, i.e., with a 600 to 800 mm side length. The pallet forms a type of additional frame, which permits transportation of the base frame 1 by stackers. If there is no pallet, for transportation by stacker, the base frame 1 must be provided with a corresponding additional frame 28, cf. FIG. 1. Base frame 1 can in turn have additional positioning means, for example, positioning openings 29 or the like in the side walls or in edge 23, for example, for receiving positioning pins. The openings in edge 23 can also be used for positive connection during the stacking of base frames 1. Components A, B, C also permit a problem-free vertical positioning, cf., for example, positioning openings 29. Pins 14 and recesses 21, 22, i.e., the grid systems 3, 6, 7, 11 can be constructed in such a way that they define specific vertical positions of components A, B, C and consequently also permit automatic handling from this respect.

Components A, B and C can be made from different materials. Apart from shaped steel or light metal sheets, they can also be made from plastic, for example, for the production of components C, it is possible to use light metal or wood.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for storing, transporting and transferring production goods such as tools, workpieces and other parts which comprises:

a base free constructed as a basic supporting member, said base frame having a plurality of walls with two opposite ones of said walls being substantially identical and having a plurality of substantially uniformly spaced recesses defining a first inner wall grid system solely along said two walls;

at least two intermediate frames each constructed as a supporting member for at least two parts receptacles for holding said production goods, each said intermediate frame being sized to fit within said base frame and having a plurality of walls, a first set of opposed ones of said intermediate frame walls having a plurality of pins defining an outer wall grid system, said pins mating with respective ones of said recesses defining said first inner wall grid system for positioning said intermediate frame within said base frame, each said intermediate frame further having a second set of opposed substantially identical walls each having a plurality of substantially uniformly spaced recesses defining a second inner wall grid system solely along said second set of walls, said second set of walls being substantially perpendicular to said first set of walls and to said two opposite walls of said base frame;

each said parts receptacle being sized to fit while one of said intermediate frames and having positioning means for engaging and positioning said receptacle within said intermediate frame;

at least one of said part receptacles having a support member and a plurality of facing engagement cavities intended to achieve non-positive engagement with one of said intermediate frames; and one of the engagement cavities forming part of a resiliently constructed snap element having a hollow section.

2. An apparatus according to claim 1 including an additional frame for enabling the base frame to be positioned in spaced manner over the ground.

3. An apparatus according to claim 1 wherein said apparatus can be positioned both horizontally and vertically, and further including positioning means in the side walls of the base frame to accomplish said vertical positioning.

4. An apparatus according to claim 3 wherein said positioning is accomplished with external positioning aids.

5. An apparatus according to claim 1 wherein at least one of said parts receptacles has an outer wall grid system forming said positioning means, said outer wall grid system being defined by a plurality of pins adapted to mate with respective ones of said recesses defining said second inner wall grid system for connecting said parts receptacle to one of said intermediate frames.

6. An apparatus according to claim 1 wherein the snap element is removable from said parts receptacle and has a release tongue which also forms an upper cover for the hollow section.

7. An apparatus according to claim 1 wherein said base frame is essentially rectangular and said intermediate frames are sized to be completely immersed within said base frame.

8. An apparatus for storing, transporting and transferring production goods such as tools, workpieces and other parts which comprises:

a base frame constructed as a basic supporting member;

said base frame having a plurality of walls with two opposite ones of said walls being substantially identical and having a plurality of substantially uniformly spaced recesses defining a first inner wall grid system solely along said two walls;

at least two intermediate frames each constructed as a supporting member for at least two parts receptacles for holding said production goods and each sized to fit within said base frame;

at least one of said intermediate frames having two opposed girders defining two sidewalls and two other walls connecting said girders;

said two other walls having a plurality of pins defining an outer wall grid system for mating with respective ones of said recesses defining said first inner wall grid system;

each of said girders having a plurality of substantially uniformly spaced recesses defining a second inner wall grid system;

at least one part receptacle having a support member and a plurality of facing engagement cavities intended to achieve non-positive engagement with said girders;

one of said engagement cavities forming part of a resiliently constructed snap element having a hollow section; and said snap element being removable from said parts receptacle and having a release tongue which also forms an upper cover for the hollow section.

* * * * *

UNITED STATES PATENT AND TRADEMARK OFFICE

CERTIFICATE OF CORRECTION

PATENT NO. : 5,050,756

DATED : September 24, 1991

INVENTOR(S) : Uwe Gerhard Tielker et al

It is certified that error appears in the above-identified patent and that said Letters Patent is hereby corrected as shown below:

In column 2, line 68, delete "S" and insert --8-- in its place.

In column 3, line 31, delete "ca" and insert --can-- in its place.

In column 5, claim 1, line 60, delete "free" and insert --frame-- in its place.

In column 6, claim 1, line 16, delete "while" and insert --within-- in its place.

Signed and Sealed this

Nineteenth Day of January, 1993

*Attest:*

*Attesting Officer*

DOUGLAS B. COMER

*Acting Commissioner of Patents and Trademarks*